United States Patent [19]

Hunter, Jr.

[11] 4,063,130

[45] Dec. 13, 1977

[54] LOW IMPEDANCE ELECTRON-BEAM CONTROLLED DISCHARGE SWITCHING SYSTEM

[76] Inventor: Robert O. Hunter, Jr., c/o Physics Department, University of California, Irvine, Calif. 92664

[21] Appl. No.: 655,235

[22] Filed: Feb. 4, 1976

[51] Int. Cl.[2] ..... H05B 41/02; H05B 41/36

[52] U.S. Cl. ..... 315/150; 307/139; 315/149; 315/347

[58] Field of Search ..... 315/149, 150, 156, 159, 315/94, 326, 340, 344, 347, 358; 317/62; 310/5, 6; 250/427; 313/213; 307/112, 149, 134, 139

[56] References Cited

U.S. PATENT DOCUMENTS

| | | | |
|---|---|---|---|
| 2,220,551 | 11/1940 | Shimizu et al. | 315/150 |
| 3,398,322 | 8/1968 | Guenther | 315/156 X |
| 3,422,307 | 1/1969 | Langer | 315/150 |
| 3,633,067 | 1/1972 | Dubois | 315/149 |

*Primary Examiner*—Eugene R. La Roche
*Attorney, Agent, or Firm*—Fitch, Even, Tabin & Luedeka

[57] ABSTRACT

A high voltage switching system switches large load currents in short periods. Gas is contained within an envelope at a pressure of the order of magnitude of at least 0.1 atmosphere. The gas provides a relatively high electron drift velocity at a relatively low electric field strength. A pair of electrodes are spaced apart within the envelope and are connected to respective switch terminals for connecting to a load. The voltage gradient between the electrodes so spaced is insufficient at rated voltage to produce any substantial secondary ionization. The gas is ionized by a beam of high energy electrons introduced into the gas through the envelope. Means is provided for turning the beam on and off, thereby closing and opening the current path through the gas and effecting the switching of current through the load.

24 Claims, 7 Drawing Figures

Fig. 1.
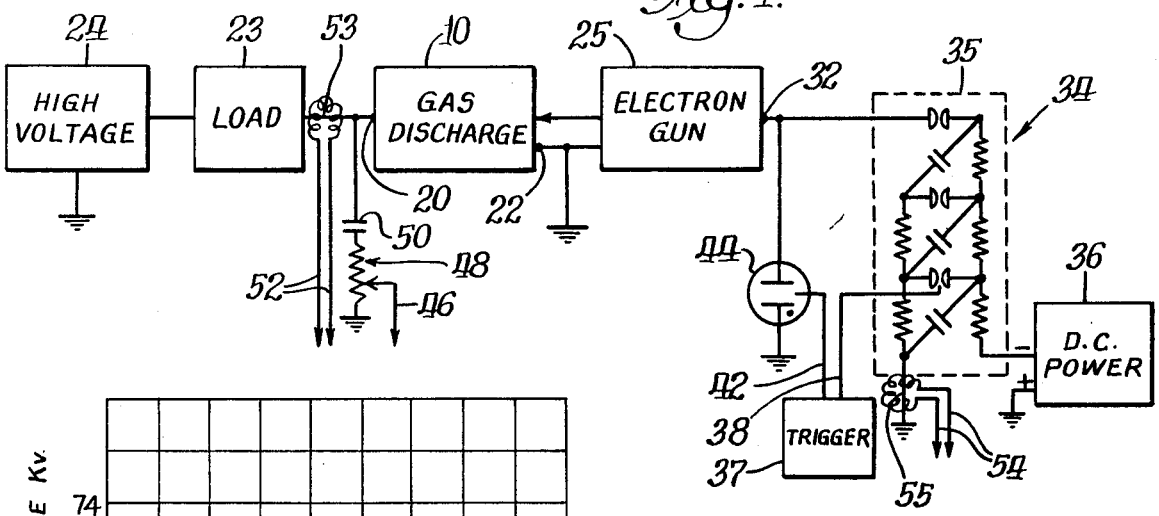
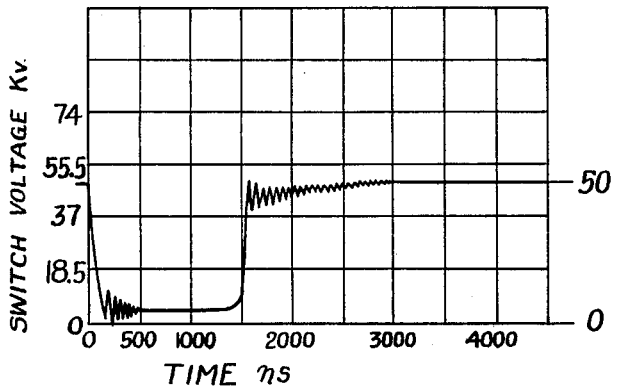
Fig. 3.
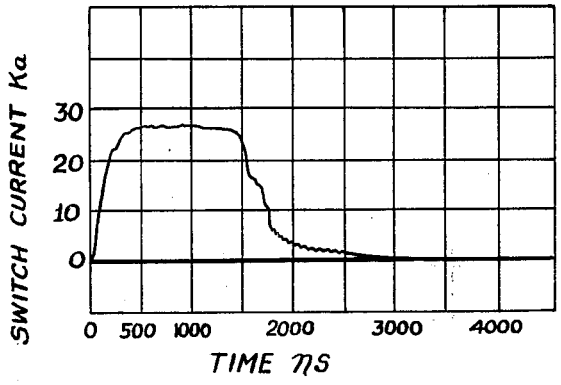
Fig. 4.
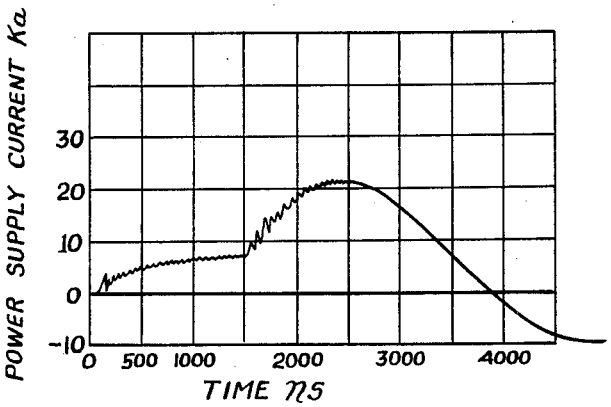
Fig. 5.

LOW IMPEDANCE ELECTRON-BEAM CONTROLLED DISCHARGE SWITCHING SYSTEM

This invention relates to high-power, high-voltage switching systems for switching large currents in short periods, and more particularly to such systems utilizing gas discharge devices controlled by electron beams.

There are many requirements for switching large currents at high voltage. Such currents may be in excess of 25 kA at 50 kV. It is also often desirable or necessary that such switching occur very rapidly, as upon the occasion of a fault in a power line where valuable equipment may burn out if the load is not promptly removed. There are also occasions where it is necessary to provide short bursts of high power, requiring voltage and current to be turned on and off in pulses. Such bursts may be repetitive.

Various high power systems have proven effective for certain purposes, but each has had shortcomings under some circumstances. Vacuum tubes are fast but inefficient, and they lack current capacity. Silicon controlled rectifiers are essentially low voltage devices that are limited in speed and may require the current to go to zero to turn off. Thyratrons are similarly limited to having to go to zero current to turn off, and they are also slow in recovering because of the time required to collect the ions. Magnetically controlled Penning ionization switches are limited in current density and recovery rate. Air blast circuit breakers and magnetically controlled breakers have relatively slow recovery times and require commutation. On the other hand, the switching system of the present invention provides uncommutated switching of large currents at high voltage at least ten times faster than such prior art devices.

The switching system of the present invention involves the use of a gas discharge device wherein ionization is controlled by irradiation with an electron beam. The gas discharge device has an envelope containing gas at what is a relatively high pressure for gas discharge devices, being more than on the order of 0.1 atmosphere and preferably on the order of 1 atmosphere. The envelope contains a pair of electrodes which are connected through the envelope to the switching terminals. The electrodes are spaced by such distance that the electric field intensity between them is insufficient at rated voltage to produce any substantial secondary ionization of the gas.

The ionization produced in the gas by the electron beam is balanced by electron attachment, ion recombination and diffusion of the ions to the envelope. Under typical operating conditions, the significant factor is that the degree of ionization is controlled primarily by the electron beam, not by the parameters of the discharge.

The switching system of the present invention has a relatively low impedance by reason of the use of gases having relatively high electron drift velocities at relatively low electric field intensities. The electron drift velocity in a given gas is determined by the cross section for elastic and inelastic scattering losses in the gas.

The scattering cross section determines the mean free path of electrons between collisions, and drift velocity is proportional to the mean free path. The Ramsauer effect produces a very small scattering cross section for electrons and hence a long mean free path. To take advantage of the Ramsauer effect, it is desirable, in one form of the invention, to utilize noble gases mixed with a small amount of molecular additive and a relatively low electric field intensity. An example is the use of argon with 1% to 5% carbon dioxide additive. Mean free path is also related to the energy loss per collision, being roughly proportional thereto. Therefore, in accordance with another aspect of the invention, molecular gases resulting in relatively large loss of energy per impact are also desirable. One such gas is methane.

As it is desirable for some purposes, as for quick opening of the switch or for quick recovery time, that the electron density be promptly reduced, in one form of the invention a relatively small amount of gas with an appropriate electron attachment cross section is added to the gas to capture the electrons promptly. A gas with an attachment threshold appreciably above about 1 ev and a relatively high capture cross section above the threshold is preferred as the additive. One such gas is $BF_3$. The additive gas should not be added in such amount as to result in a significant alteration of the drift velocity, the level being such that during the ionization process, volumetric recombination in the principal gas is the dominant loss process. With an attachment threshold above the energy of nearly all of the electrons in the discharge, which are typically of energy between 0.1 and 0.5 ev, capture of electrons by the additive is relatively negligible during the ionization process. On the other hand, when the electron beam is turned off, the electrons begin to be taken from the discharge by volumetric recombination and other processes. The voltage between electrodes thereupon begins to rise, accelerating remaining electrons above the attachment threshold of the additive, which thereupon rapidly captures the higher energy electrons, speeding cutoff of the switch. $BF_3$ is a suitable additive. It captures electrons by a dissociative process, hence requiring electrons having energy at least great enough to overcome the binding energy of the molecule. The attachment threshold for $BF_3$ is about 10 ev, and the molecule captures electrons strongly at energies above the threshold.

A single gas having such attachment threshold may be used to fill the discharge chamber provided that it also has the necessary switching properties of a relatively high electron drift velocity at a relatively low electric field intensity at a relatively high pressure of the order of magnitude of at least 0.1 atmosphere. $BF_3$ is a suitable single gas. In addition to having a suitable attachment threshold and strongly capturing electrons above 10 ev, it provides a relatively high electron drift velocity at low electric field intensities. It exhibits the Ramsauer effect such as argon. A gas such as $BF_3$ is capable of turn off in times of the order of $10^{-8}$ sec with a particularly high withstand voltage.

It is therefore a principal object of the present invention to provide a high-power, high-voltage switching system for switching large currents in short periods, particularly in pulses. It is another object of the present invention to provide such system wherein switching is effected by controlling the impedance of gas discharge devices with electron beams. Other objects of the invention will become apparent from consideration of the following description, particularly when taken with the accompanying drawings, in which:

FIG. 1 is a diagrammatic illustration of one form of switching system of the present invention;

FIG. 3 is a graph showing the voltage across the switch illustrated in FIG. 1 upon closing and opening;

FIG. 4 is a graph showing the current through the switch of FIG. 1 upon closing and opening;

FIG. 5 is a graph showing the current in the power supply for the electron gun in the system of FIG. 1 upon closing and opening;

Figure 2:
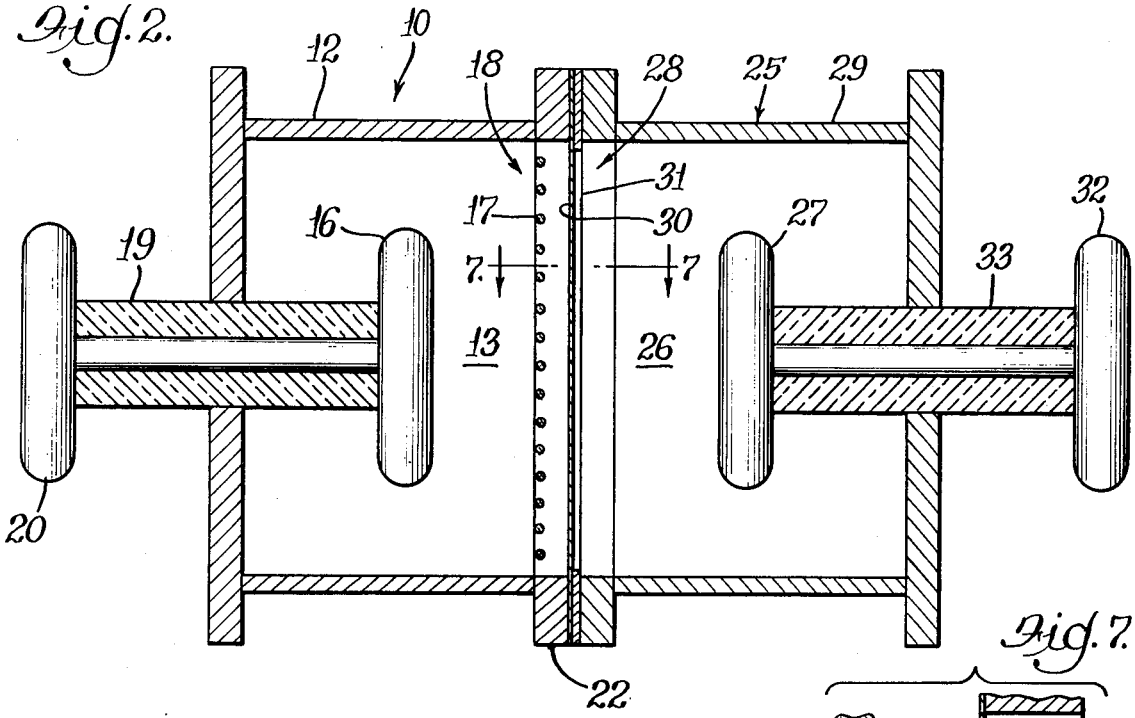
FIG. 2 is a sectional view of one form of electron gun and gas discharge device used in the switching system of FIG. 1.
Figure 7:
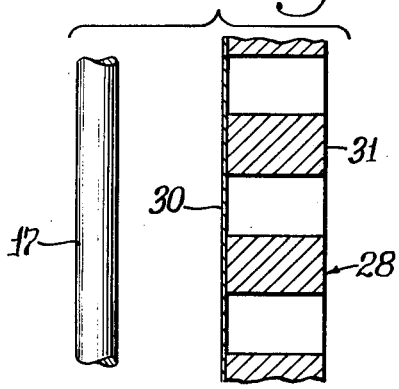
FIG. 7 is an enlarged sectional view of the window and grounded electrode of the gas discharge device of FIG. 2, taken along line 7—7 in FIG. 2.

As shown in FIGS. 1 and 2, the switching system of the present invention includes a gas discharge device 10 comprised of an envelope 12 enclosing a space 13 filled with gas. Disposed within the envelope are electrodes 16 and 18, spaced and insulated from one another, with the gas in between. The electrode 16 is connected through an insulator 19 passing through the envelope 12 to an external switching terminal 20. As shown, the electrode 18 is formed of spaced rods 17 mounted on the envelope 12, which may be grounded at a grounded switching terminal 22.

The gas discharge device 10 is connected to a load 23 to be switched by way of these switching terminals 20 and 22. For example, as shown in FIG. 1, the gas discharge device 10 is connected at the terminal 20 through the load 23 to a high voltage supply 24, the circuit being completed through a ground connection to the terminal 22. The switching system is operated by controlling the electrical impedance of the gas in the space 13 between the electrodes 16 and 18. In accordance with the present invention, this impedance is controlled by controlling the ionization of the gas with an electron gun 25. The electron gun 25 may be a cold cathode electron gun, wherein electrons are accelerated across an evacuated space 26 by an electric field produced by voltage supplied between a cathode 27 and an anode 28 of the electron gun circuit. The vacuum in the space 26 is confined by an envelope 29. The anode 28 closes one end of the space. The anode 28 is made in the form of a grounded gas-tight window in the envelope 29. The window comprises a 1 mil titanium foil 30 supported by a grid 31. The grid may be a metal plate with milled slots covered on the pressurized side by the foil 30. The foil 30 separates the evacuated space 26 from the relatively high pressure gas in the space 13 while permitting relatively easy passage of electrons at a relatively high energy. The electrons are accelerated to sufficient energy in the electron gun as to penetrate the window with the loss of a relatively small portion of their energy. The electrons, scattered by the foil 30, thus penetrate the envelope 12 and pass between the rods 17 into the space 13, ionizing the gas therein. Electron accelerating voltage is applied to a terminal 32 connected through an insulator 33 in the envelope 29. This voltage is supplied by a power supply 34 connected to the terminal 32.

The gas discharge device 10 and the electron gun 25 may be substantially circularly symmetrical about a common axis of rotation.

In the particular circuit illustrated in FIG. 1, the power supply 34 is a pulsed voltage source, comprising a Marx tank 35. The Marx tank 35 is charged from a DC power supply 36 and is controlled by trigger pulses applied from a trigger pulse circuit 37 over a control circuit 38. Each pulse applied to the control circuit 38 is applied in a conventional manner to a discharge gap in the Marx tank 35, breaking down that gap and, thence, progressively the other discharge gaps in the Marx tank, thereby placing the capacitors of the Marx tank in series and applying a high voltage between the cathode 27 and the anode 28. This voltage provides the electric field for drawing electrons from the cathode 27 and accelerating them in the evacuated space 29 to a velocity sufficient to enable them to penetrate the foil 30 with relative ease.

In its quiescent state, the gas discharge device 10 provides an extremely high impedance between the switching terminals 20 and 22. The spacing of the electrodes 16 and 18 is such that the electric field intensity between them is insufficient at rated voltage to produce any substantial secondary ionization of the gas. Thus, a very high voltage may be supported across the switching system.

When it is desired to close the switch, a trigger pulse from the trigger pulse circuit 37 is applied to the control circuit 38 to cause the electron gun 25 to drive electrons through the foil 30 into the space 13 at high energy, ionizing the gas and thus lowering its impedance and permitting an electrical discharge between the electrodes 16 and 18. The electrode 18 is at the same potential (ground) as the foil 30 but is spaced therefrom by a suitable distance (e.g., 1 cm) so that the discharge does not damage the fragile foil. The impedance is determined by the energy and intensity of the electrons in the electron beam. As it is desired that the switching system operate rapidly, the impedances of the circuitry connecting the power supply 34 to the electron gun 25 provide very short time constants, whereby the ionization of the gas in the space 13 may substantially reach equilibrium in times much less than the desired conduction time. For the specific case, this condition is reached in less than 0.2 ns.

When it is desired to turn the switch off, a control pulse is applied from the trigger pulse circuit 37 over a control circuit 42 to a gas discharge tube 44 connected across the output of the power supply 34. When the gas discharge tube 44 breaks down, it short-circuits the output of the power supply 34 to ground, thereby turning off the electron gun 25. Again, the electronic components provide a time constant whereby the current supplied to the electron gun 25 is substantially turned off in less than 0.2 $\mu$sec, thereby turning off the continued ionization of the gas in the space 14.

Preferably, the gas, either inherently or by the addition of an additive, has sufficient electron capture cross section as to dissipate the ionization rapidly to assure rapid turn-off of the switch.

The device as illustrated in FIGS. 1 and 2 represents a pulsable switching system. FIGS. 3, 4 and 5 illustrate the operation of the switch as used in controlling a high-voltage power supply 24 of 50 kV, operating through a 2 ohm load 23. FIG. 3 illustrates the voltage across the switch as a function of time, the voltage on the terminal being measured on a lead 46 connected to a potentiometer 48 connected through a coupling capacitor 50 to the terminal 20. FIG. 4 illustrates the current through the switch as a function of time, the current being measured on leads 52 inductively coupled to a conductor 53 connecting the load 23 to the terminal 20. FIG. 5 illustrates the current from the power supply 34 as a function of time, as measured on leads 54 inductively coupled to a conductor 55 connecting one side of the Marx tank 35 to ground.

As shown in FIG. 3, the voltage on the terminal 20 was 50 kV until the control signal was applied to the control circuit 38, thereby turning on the power supply 34 (FIG. 5) and ionizing the gas in the space 13. The gas thereupon became conductive, conducting approximately 25 kA (FIG. 4), with the switch voltage dropping to about 1 kV (FIG. 3). The switch remained conducting for about 1.5 μsec, whereupon a control pulse applied to the control circuit 42 turned off the power supply 34. Thereupon the voltage across the switch recovered to the 50 kV of the voltage source 24 without arcing (FIG. 3), and the current through the switch dropped to zero (FIG. 4). As shown in FIG. 5, the current from the power supply 34 increased when short-circuited; however, this represented current flowing in the gas discharge tube 44, the current oscillating because of inherent inductance in the system.

The particular gas discharge device 10 by which the curves of FIGS. 3, 4, and 5 were developed had a volume $10 \times 10 \times 100$ cm containing methane at about 1 atmosphere pressure. The electrodes 16 and 18 were spaced 10 cm apart. The electron gun provided a beam of electrons at about 5 kA. The system switched 50 kV voltage with a current of 25 kA on and off in less than about 0.2 μsec each. The power switched was thus $1.25 \times 10^9$ w. The rate of current switching was greater than $10^{11}$ A/sec and the rate of change of voltage was greater than $2 \times 10^{11}$ V/sec.

Although a specific embodiment of the present invention has been illustrated and described with particularity, various modifications may be made therein within the scope of the present invention. Other gases may be used in the discharge device. The electron gun may take various forms. Different shapes and sizes of electrodes may be used. The electron gun may provide a continuous electron beam, rather than a pulsed beam. Further, the switching system may be used in conjunction with more conventional switches. For example, in turning on a circuit, it may be desirable to utilize a conventional switch in parallel with the switch of the present invention, permitting the switch of the present invention to close the circuit rapidly, while short-circuiting this switch with a conventional switch for the long term, thus conserving energy otherwise lost in the operation of this switch.

Figure 6:
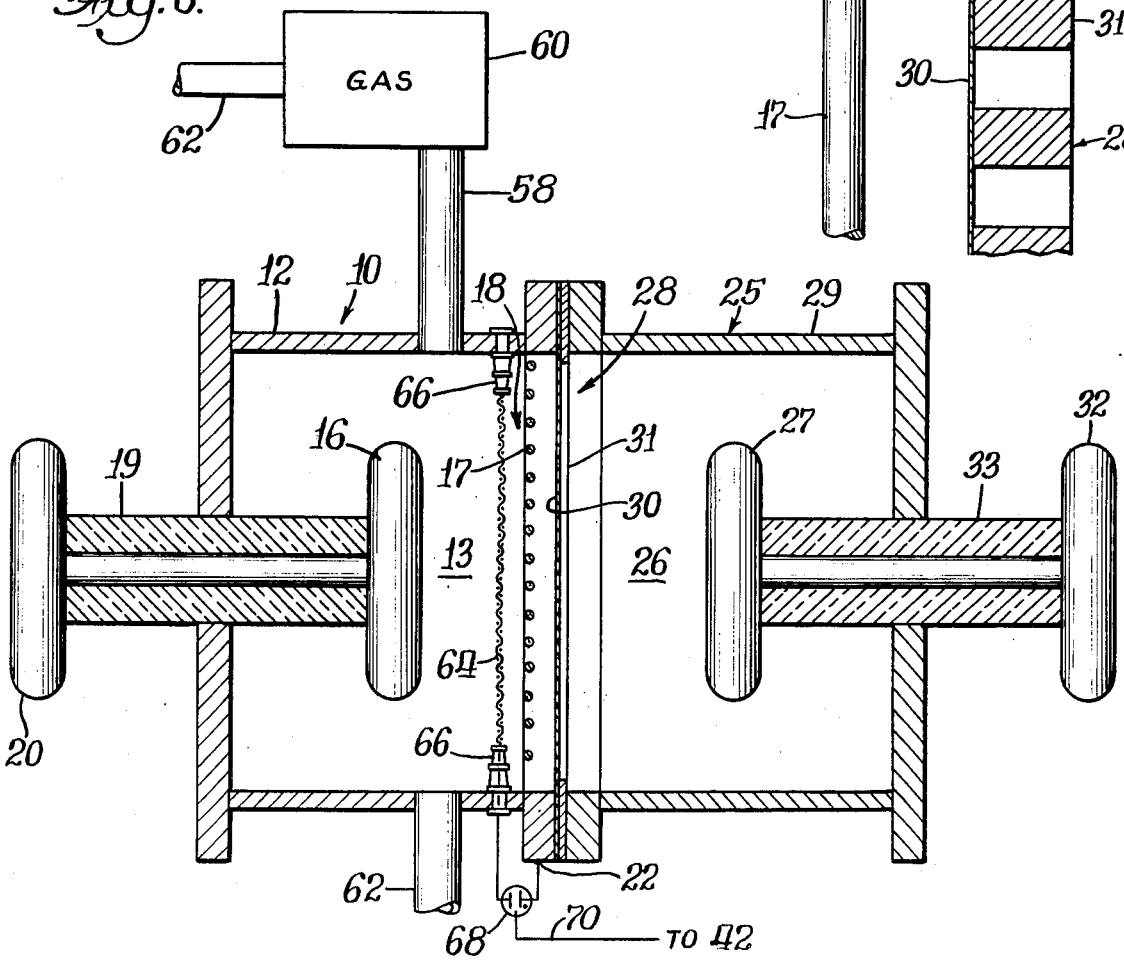
FIG. 6 is an illustration, partly in section and partly diagrammatic, of another form of electron gun and gas discharge device used in the switching system of FIG. 1.

A modified form of gas discharge device is shown in FIG. 6. This adds two features to the apparatus as illustrated in FIG. 2, gas cooling and isolation of the electrode 18, both of which enhance the cutoff capability of the switch. As there shown, the switching gas is continuously fed into the space 13 through an inlet tube 58 from a gas source 60. The gas flows through the gas discharge device 10 and out an outlet tube 62 whence it may return to the gas source 60. The gas source 60 may include suitable pumps, gauges and cooling means for maintaining the appropriate pressure, flow rate and temperature for gas in the device 10. The effect of the gas flow is to exchange cool gas for hot gas. The gas in the discharge device 10 is heated by the electron beam and by electrical discharge through the gas. This heating produces expansion of the gas between the electrodes 16 and 18 and unstable regions between hot and cool regions of the gas. Expansion of the gas reduces its impedance undesirably, making the switch more susceptible to restrike. The heating is particularly severe at high switching rates and could result in switch failure under extreme conditions. It is difficult to cool the gas in the envelope 12 from outside the envelope because the gas is not a good thermal conductor. On the other hand, the exchange of cool gas for hot alleviates the problem.

The other added feature comprises a guard electrode 64 which is utilized to isolate the gas region around the electrode 18 from the rest of the discharge space 13. It is a natural phenomenon in electrical discharges in gases that a substantial part of the voltage drop therein occur at the cathode or negative side of the discharge. This part of the voltage drop is known as the cathode fall. A consequence of the cathode fall is that the gas near the cathode is more highly heated than other parts of the gas. This expands the gas, increasing its conductivity and thus making it more susceptible to breakdown and hence restrike when the switch is opened. The situation is aggravated by the relatively small diameter of the rods 17 which increases the field intensity near the rods 17. The operation of the guard electrode 64 alleviates the problem by isolating the cathode fall region upon the opening of the switch.

The guard electrode 64 may be, as shown, in the form of a conductive mesh mounted in the envelope 12 on insulators 66 near the electrode 18 but spaced therefrom by perhaps 1 cm. While the switch is closed and during a discharge in the device 10, the guard electrode 64 is allowed to float or is placed at some positive potential. Upon opening of the switch, the guard electrode 64 is clamped to the electrode 18. This is achieved by a gas discharge tube 68 fired by a control signal applied from the trigger pulse circuit 37 over a control circuit 70. The control circuit 70 may be connected to the control circuit 42 for turning off the electron gun 25 so that both operate at the same time. Firing of the gas discharge tube 68 clamps the guard electrode 64 to ground at the ground terminal 22. This effectively removes from the switch circuit the region of the discharge device 10 between the guard electrode 64 and the electrode 18 as both are at ground potential, and there is no high potential gradient where the gas has been rarefied. This eliminates the possibility of conduction and hence of restrike occasioned by cathode fall.

In the form of the invention illustrated in FIG. 6, the electrode 18 is the cathode of the discharge device 10, the voltage source 24 being DC. In the event that the voltage source 24 is AC, a similar guard electrode may be placed adjacent the electrode 16 and similarly controlled to connect it electrically to the electrode 16 upon opening of the switch.

For the sake of efficency, the power utilized in producing the electron beam should about equal that lost in the gas discharge device. More energy in the beam would decrease the impedance of the discharge device and hence improve its efficiency, but only at the expense of energy lost in the production of electrons. On the other hand, conserving energy in the production of electrons results in greater loss of power in the discharge device.

Various loads and voltages may be switched. For example, the switching system may be used for coupling inductively stored energy to a load by opening the conductive path short-circuiting the storing inductor.

The switching system may be repetitively switched at relatively high rates because of the rapid recovery time of the system.

The switches may be stacked in series for very high standoff voltage.

What is claimed is:

1. A high-voltage switching system for switching large load currents in short periods comprising an envelope, gas contained within said envelope at a pressure of the order of magnitude of at least 0.1 atmosphere, said gas providing a relatively high electron drift velocity at relatively low electric field intensity, first and second terminals external to said envelope for connection in a switching circuit, first and second electrodes spaced apart within said envelope and connected to said first and second terminals, respectively, the electric field intensity between said electrodes so spaced being insufficient at rated voltage to produce any substantial secondary ionization of the gas, an electron beam generator for introducing a beam of high energy electrons into said gas through said envelope to ionize said gas, and means for turning said beam on or off.

2. A switching system according to claim 1 wherein said pressure is of the order of 1 atmosphere.

3. A switching system according to claim 1 including means for continuously flowing said gas into, through and out of said envelope, said gas being relatively cool when introduced into said envelope.

4. A switching system according to claim 1 including a guard electrode mounted between said first and second electrodes adjacent to and electrically isolated from said second electrode, and means coupled to said means for turning said beam off for electrically substantially clamping said guard electrode to said second electrode upon operation of said means to turn said beam off.

5. A switching system according to claim 1 wherein said gas is a molecular gas providing a relatively large loss of energy per electron collision, and at the same time a relatively long mean free path for electrons under the operating conditions of the switch.

6. A switching system according to claim 5 wherein said gas consists essentially of methane.

7. A switching system according to claim 1 wherein said gas has an attachment threshold for electrons above the energies of nearly all of the electrons normally present during electrical discharge between said first and second electrodes and a relatively high capture cross section for electrons at energies above said threshold.

8. A switching system according to claim 7 wherein said gas consists essentially of $BF_3$.

9. A switching system according to claim 1 wherein said means for turning said beam on or off includes means for turning said beam on and means for turning said beam off, thereby turning the current through said gas substantially on and off, respectively.

10. A switching system according to claim 9 wherein said means for turning said beam on and said means for turning said beam off operate to produce pulses of electrons in said gas.

11. A switching system according to claim 9 wherein upon operation of said means for turning said beam on and said means for turning said beam off, the current through said gas is turned substantially on and off, respectively, in less than 0.2 μsec.

12. A switching system according to claim 1 wherein said gas provides a relatively long mean free path for electrons.

13. A switching system according to claim 12 wherein said gas consists essentially of a noble gas mixed with a molecular gas.

14. A switching system according to claim 12 wherein said gas includes a relatively small proportion of a gas having a relatively high electron capture cross section.

15. A switching system according to claim 14 wherein said gas having a relatively high electron capture cross section has an attachment threshold for electrons above the energies of nearly all of the electrons normally present during electrical discharge between said first and second electrodes.

16. A switching system according to claim 14 wherein said gas having a relatively high electron capture cross section is $BF_3$.

17. A switching system according to claim 7 wherein said gas having a relatively high electron capture cross section has an attachment threshold for electrons above 1 ev.

18. A switching system according to claim 17 wherein said small proportion is of the order of no more than about 1%.

19. A switching system according to claim 1 wherein said gas comprises primarily a noble gas containing a relatively small proportion of a gas having a relatively high electron energy loss cross section.

20. A switching system according to claim 19 wherein said gas includes a relatively small proportion of a gas having a relatively high electron capture cross section.

21. A switching system according to claim 20 wherein said gas having a relatively high electron capture cross section has an attachment threshold for electrons above the energies of nearly all of the electrons normally present during electrical discharge between said first and second electrodes.

22. A switching system according to claim 20 wherein said gas having a relatively high electron capture cross section is $BF_3$.

23. A switching system according to claim 20 wherein said gas having a relatively high electron capture cross section has an attachment threshold for electrons above 1 ev.

24. A switching system according to claim 23 wherein said small proportion is of the order of no more than about 1%.

* * * * *

UNITED STATES PATENT AND TRADEMARK OFFICE

CERTIFICATE OF CORRECTION

PATENT NO. : 4,063,130

DATED : December 13, 1977

INVENTOR(S) : Robert O. Hunter, Jr.

It is certified that error appears in the above-identified patent and that said Letters Patent are hereby corrected as shown below:

Column 2, line 51, change "such" to --much--.

Column 8, line 27, (Claim 17, line 1), change "7" to --14--.

Column 8, line 30, change "1 ev." to --1%.--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,063,130
DATED : December 13, 1977
INVENTOR(S) : Robert O. Hunter, Jr.

It is certified that error appears in the above—identified patent and that said Letters Patent is hereby corrected as shown below:

Column 2, line 51, change "such" to -- much --.

Column 8, line 27, (Claim 17, line 1), change "7" to -- 14 --.

This certificate supersedes Certificate of Correction issued July 4, 1978.

Signed and Sealed this

*Fifteenth* Day of *July 1980*

[SEAL]

*Attest:*

SIDNEY A. DIAMOND

*Attesting Officer*

*Commissioner of Patents and Trademarks*